United States Patent [19]

Dirmeyer

[11] Patent Number: 4,728,919

[45] Date of Patent: Mar. 1, 1988

[54] MOISTURE-TIGHT WOUND FERRITE TOROIDAL CORE WITH RESIN ENVELOPE

[75] Inventor: Josef Dirmeyer, Bodenwoehr, Fed. Rep. of Germany

[73] Assignee: Siemens Aktiengesellschaft, Berlin and Munich, Fed. Rep. of Germany

[21] Appl. No.: 924,334

[22] Filed: Oct. 29, 1986

[30] Foreign Application Priority Data

Nov. 25, 1985 [DE] Fed. Rep. of Germany ..... 3541626

[51] Int. Cl.[4] ..... H01F 27/02; H01F 27/26

[52] U.S. Cl. ..... 336/92; 336/96; 336/192; 336/198

[58] Field of Search ..... 336/96, 229, 100, 198, 336/136, 84 C, 205, 90, 92; 174/525

[56] References Cited

U.S. PATENT DOCUMENTS

| | | | |
|---|---|---|---|
| 1,784,833 | 12/1930 | Hagemann | 336/198 X |
| 2,216,863 | 10/1940 | Visman | 336/198 |
| 2,975,386 | 3/1961 | Coy et al. | 336/229 X |
| 3,018,455 | 1/1962 | Brandon, Jr. et al. | 336/100 |
| 3,132,316 | 5/1964 | Elman et al. | 336/100 X |
| 3,148,346 | 9/1964 | Goethe et al. | 336/96 |
| 3,290,635 | 12/1966 | Hofmann et al. | 336/96 X |
| 3,387,244 | 6/1968 | Davis | 336/92 |
| 3,465,273 | 9/1969 | Brock | 336/62 |
| 3,523,040 | 8/1970 | Lee . | |
| 3,648,337 | 3/1972 | Greskamp et al. | 174/525 |
| 3,649,939 | 3/1972 | Hildebrandt | 336/205 |
| 3,781,740 | 12/1973 | Kirmis et al. | 336/96 |
| 4,107,636 | 8/1978 | DiGirolamo | 336/92 |
| 4,510,476 | 4/1985 | Clatterbuck et al. | 336/84 C |
| 4,571,569 | 2/1986 | Scharl | 336/65 |

FOREIGN PATENT DOCUMENTS

| | | | |
|---|---|---|---|
| 0072151 | 2/1983 | European Pat. Off. . | |
| 1163930 | 6/1970 | Fed. Rep. of Germany . | |
| 2058509 | 5/1972 | Fed. Rep. of Germany . | |
| 2245197 | 4/1974 | Fed. Rep. of Germany | 336/136 |
| 3324078 | 1/1985 | Fed. Rep. of Germany | 336/229 |
| 1333081 | 3/1985 | Fed. Rep. of Germany . | |
| 1325184 | 3/1963 | France | 336/136 |
| 499188 | 12/1970 | Switzerland . | |
| 1239439 | 7/1971 | United Kingdom . | |
| 1253599 | 11/1971 | United Kingdom . | |

*Primary Examiner*—Thomas J. Kozma

*Attorney, Agent, or Firm*—Hill, Van Santen, Steadman & Simpson

[57] ABSTRACT

A ferrite toroidal core is inserted into an annular trough enclosed by a cap with a winding applied about the trough member which is then sealed by an envelope of resin. The trough member includes resilient tabs extending internally of at least one mutually concentric trough wall, the tabs having their free edges disposed against the toroidal core so that the core is fixed and centered within the trough and so that an air cushion is provided between the core and the trough wall.

10 Claims, 5 Drawing Figures

MOISTURE-TIGHT WOUND FERRITE TOROIDAL CORE WITH RESIN ENVELOPE

BACKGROUND OF THE INVENTION

1. Field of the Invention

The present invention relates to a ferrite toroidal core in an annular trough having a winding applied around the trough.

2. Description of the Prior Art

Wound ferrite toroidal cores which are used, for instance, in toroidal core inductors and transformers are provided with an envelope of casting resin or of thermoplastic synthetic resin. When the resin envelope is applied, a pressure caused by the shrinkage of the resin as it hardens on the ferrite toroidal core potentially causes destruction or at least a considerable deterioration of the electrical and magnetic properties of the ferrite toroidal core. This is assuming that the ferrite core has inadequate protection.

As a protection means for the ferrite toroidal core, a trough member has been developed having an annular shape and closed by a cap, the trough member being formed of thermoplastic material. Over and above this, it has been proposed to protect the ferrite toroidal core with a coating of wax or a similar material, thus providing a buffer between the bare ferrite core and the resin envelope to provide a barrier for the shrinkage forces exerted by the envelope during hardening.

A technique known as "soft casting" has been created for the resin envelope. However, soft casting does not provide an adequately tight envelope and, consequently, leads to a decrease in the insulation value of the envelope such as when the wound core is stored in a damp area.

SUMMARY OF THE PRESENT INVENTION

An object of the present invention is to protect a bare ferrite toroidal core against shrinkage pressures which occur during hardening of a resin envelope material by providing an improved trough member for the ferrite core.

A further object of the present invention is to provide a simple and inexpensive faultless hermetic seal between a trough member and its cap which encloses a ferrite toroidal core.

These and other objects are achieved in a trough member having internal resilient tabs on at least one of the mutually concentric trough walls into which an unwound ferrite toroidal core is inserted. The resilient tabs are one with the trough wall and have at least their free end edges abutting the ferrite toroidal core such that the core is centered within the trough. A cap forms a cover over the open face of the annular trough and is hermetically sealed to the trough walls by, for example, ultrasonic welding.

To create an air cushion between the ferrite core and the outside trough wall, the ferrite core is preferably arranged in the trough with play and the tabs are preferably uniformly distributed about the trough circumference to center and fix the core in position.

The resilient tabs guarantee a quasi-free centering and fixing of the toroidal core within the trough so that air cushions are formed between the core and the trough walls. The air cushions serve to protect the bare ferrite toroidal core when the envelope material hardens and shrinks. The air cushions are adjustable by the initial selection of the amount of play between the core and the trough walls and by the initial selection of the tabs and, in particular, the spring power of the tabs.

DESCRIPTION OF THE PREFERRED EMBODIMENTS

Figure 1:
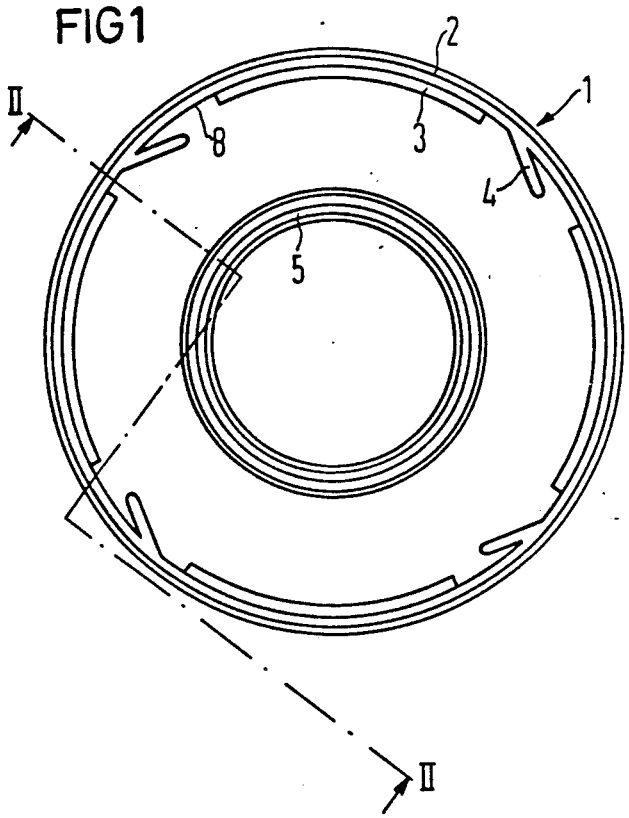
FIG. 1 is a plan view of a trough in accordance with the principles of the present invention.

As shown in FIG. 1, a trough is denoted generally at 1 formed of thermoplastic material and including outer and inner trough walls 2 and 5 which are mutually concentric and connected by a bottom wall to form an annular space. With reference to the cross section of FIG. 2, the trough walls 2 and 5 include a peaked ridge on their respective end faces. A cover 6 is welded on the end faces of the trough walls 2 and 5, such as by ultrasound welding. As a result of the ridge on the end faces, a maximum energy transmission occurs during the ultrasound welding of the cover 6 to the end faces. The peaked ridge may have other shapes than that shown, and in an alternate embodiment, may be provided on the cover 6 instead of on the end faces of the walls 2 and 5.

Figure 2:
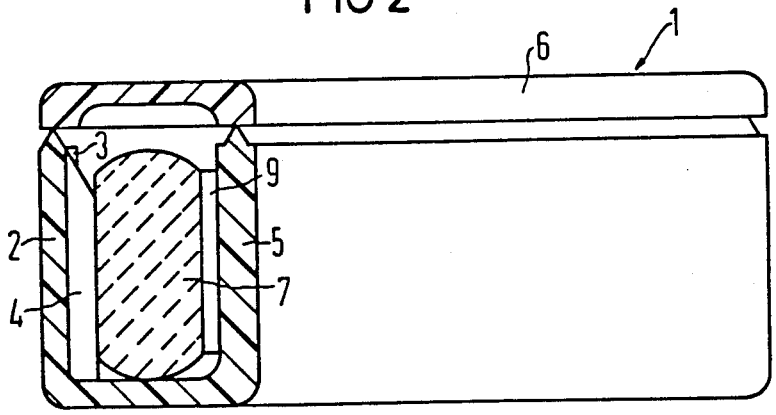
FIG. 2 is a cross section along line II—II of FIG. 1 of the trough showing a cover and a core in place.
Figure 3:
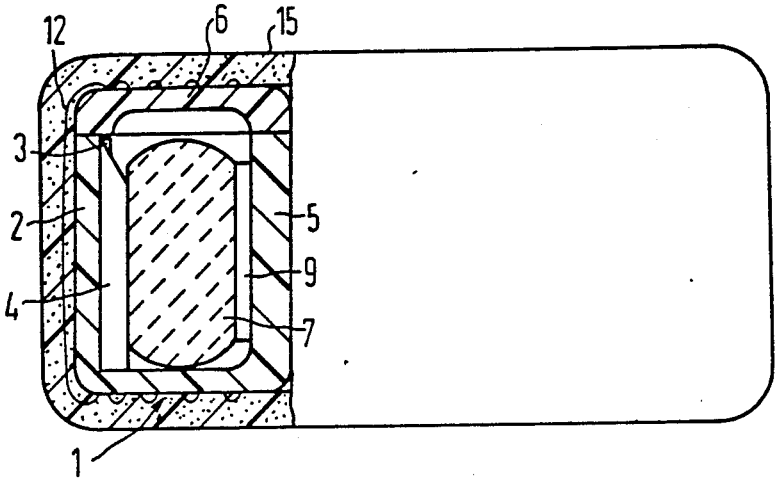
FIG. 3 is a cross section similar to that of FIG. 2 showing a further stage of assembly, including a winding and an envelope.

From the inside of the trough wall 2, a resilient tab extends, preferably formed in one piece with the trough wall 2. The tabs 4 are provided at niches 8 formed between portions of an addition wall 3 that lies at the inside of the trough wall 2. Instead of or in addition to the tabs 4, other tabs (not shown) can extend from the inner wall 5. A ferrite or iron toroidal core 7 is placed into the annular space in the trough member 1, as can be seen in FIGS. 2 and 3. The resilient tabs 4 have their free edges pressing against the core 7 so that the core 7 is fixed and centered in the trough member 1. The ferrite core 7 is, thereby, arranged in the trough 1 with play so that a more or less large air cushion 9 is formed between the ferrite toroidal core 7 and a trough wall 5. The size of the air cushion 9 depends on the thickness of the core 7 and on the size and shape of the trough 1. Additional air cushions are present at the niches 8, the size of which depends on the position of the tabs 4 between the core 7 and the wall portions 3.

The top edges of the tabs 4 are beveled so that the core 7 is accepted within the trough 1 without being impeded by the tabs 7. Although tabs having a straight free edge and a straight beveled top edge are shown, other shapes of tabs are also contemplated.

The trough member 1 is closed hermetically tight by welding the cover 6 thereto. Windings 12 are wound about the assembled trough, and cover 6, as seen in FIG. 3, and the assembly is enveloped with a casting resin or a thermoplastic synthetic resin 15. As the resins 15 harden, high shrinkage forces arise which, without the air cushions 9, would lead to destruction or at least to deterioration of the characteristics of the ferrite toroidal core 7. Depending on the anticipated shrinkage pressure, the play of the ferrite core 7 within the trough member 1 and the resiliency of the tabs 4 are selected in advance.

Figure 4:
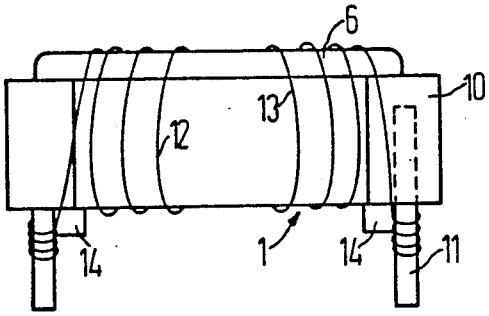
FIG. 4 is an elevational view of another embodiment of a trough of the present invention, the trough being sealed with a cover and wound with a winding.
Figure 5:
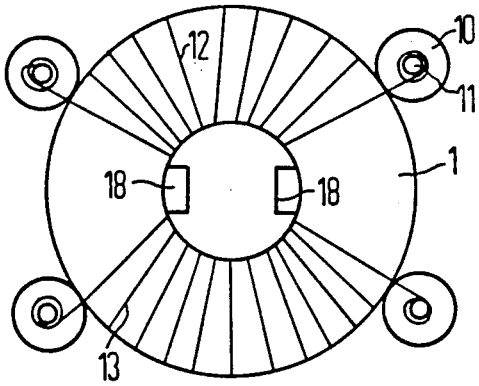
FIG. 5 is a bottom plan view of the embodiment shown in FIG. 4.

Referring now to FIGS. 4 and 5, the trough 1 includes webs 18 extending inwardly from the exterior of the inner trough wall 5 for separating the winding 12 from a winding 13, such as when the windings 12 and 13 are at different potentials. Eyelets 10 are mounted on the outside of the trough 1 and serve as carriers for terminal pins 11. The eyelets 10 are shown as each having a cylindrical shape with a bore extending along at least a portion of its axis. Other types of terminal pin holders can be used in place thereof as well. Spacers 14 extending from the bottom of the trough 1 assure that the necessary space is present between the finished wound core assembly and a surface, such as a printed circuit board, on which it is mounted. The webs 18, the eyelets 10, and the spacers 14 are preferably all formed in one piece with the trough member 1.

Although modifications and changes may be suggested by those skilled in the art, it is the intention of the inventor to embody within the patent warranted hereon all changes and modifications as reasonably and properly come within the scope of his contribution to the art.

I claim as my invention:

1. A wound ferrite toroidal core including a winding, a ferrite core member, and a resin envelope, comprising:

an annular trough member of thermoplastic material and including mutually concentric trough walls each with an end face at an open side of said trough member;

resilient tabs extending from an inside surface of at least one of said trough walls and having free edge faces, said resilient tabs being flattened angularly-projecting axially-extending flexible member's;

said ferrite core member disposed within said trough member with at least said free edge faces of said tabs disposed against said core member such that said core member is centered in said trough member; and a cap sealed over said end faces of said trough walls to form a cover said trough member;

whereby the winding is wound around said trough member and said cap and then enveloped in resin.

2. A wound ferrite toroidal core as claimed in claim 1, wherein said resilient tabs are uniformly distributed about the circumference of said inside surface of at least one of said trough walls, said ferrite core member being centered and fixed in position by said resilient tabs so that an air cushion is created between said ferrite core member and and outside one of said mutually concentric trough walls.

3. A wound ferrite toroidal core as claimed in claim 1, wherein said resilient tabs are arranged in wall niches formed at the inner surface of at least one of said trough walls.

4. A wound ferrite toroidal core as claimed in claim 1, further comprising eyelets affixed to an outer wall of said trough member, and a terminal pin mounted in each of said eyelets.

5. A wound ferrite toroidal core as claimed in claim 1, wherein said cap is welded to said end faces of said trough walls by ultrasound welding.

6. A wound ferrite toroidal core as claimed in claim 1, wherein said end faces of said trough walls include a peaked ridge extending therealong to provide a surface for welding.

7. A wound ferrite toroidal core as claimed in claim 1, further comprising webs extending from an exterior surface of an inner one of said trough walls, whereby said webs separate different potential portions of the winding.

8. A wound ferrite toroidal core assembly, comprising:

an annular trough member including concentric inner and outer trough walls, said inner and outer walls each having an end face, said end faces each having a ridge extending along said end faces;

a ferrite toroidal core member disposed within said annular trough member;

a plurality of resilient tabs extending inwardly from an inner surface of said outer trough wall and formed in one piece with said trough member, said resilient tabs each having a free end abutting said core member to hold said core member centrally within said trough member and thereby define an air space between said core member and at least one of said inner and outer trough walls;

a cover sealed over said end faces of said inner and outer trough walls;

a winding applied about said trough member and said cover; and a resin envelope over said winding and said trough member and said cover.

9. A wound ferrite toroidal coil assembly as claimed in claim 8, wherein said assembly is adapted for mounting on a surface, further comprising:

at least one web extending from an exterior surface of said inner trough wall to separate portions of said winding;

a plurality of terminal pins connected to said winding;

a plurality of terminal pin holders extending from said trough member, each of said terminal pin holders secured to one of said terminal pins; and at least one spacer extending from said trough member for abutting a surface on which said coil assembly is to be mounted.

10. A wound ferrite toroidal coil assembly as claimed in claim 8, wherein said winding includes different portions connected to different potentials.

* * * * *